US009808091B1

(12) United States Patent
Goldszer

(10) Patent No.: US 9,808,091 B1
(45) Date of Patent: Nov. 7, 2017

(54) CHAIR WITH CELL PHONE AND ACCESSORY POUCH

(71) Applicant: JGR Copa LLC, Hollywood, FL (US)

(72) Inventor: Jacob Goldszer, Hollywood, FL (US)

(73) Assignee: JGR Copa, LLC, Hollywood, FL (US)

( * ) Notice: Subject to any disclaimer, the term of this patent is extended or adjusted under 35 U.S.C. 154(b) by 68 days.

(21) Appl. No.: 15/148,559

(22) Filed: May 6, 2016

(51) Int. Cl.

| | |
|---|---|
| ***A47C 7/62*** | (2006.01) |
| ***A45C 11/00*** | (2006.01) |
| ***A47C 4/28*** | (2006.01) |
| *A47C 31/11* | (2006.01) |

(52) U.S. Cl.
CPC ..... *A47C 7/62* (2013.01); *A45C 11/00* (2013.01); *A47C 4/28* (2013.01); *A45C 2011/002* (2013.01); *A47C 31/11* (2013.01)

(58) Field of Classification Search
CPC .. A47C 7/62; A47C 31/11; A47C 4/28; A45C 11/00; A45C 2011/002
USPC ..... 297/188.2, 188.01, 188.18, 188.19; 224/275, 277, 278
See application file for complete search history.

(56) References Cited

U.S. PATENT DOCUMENTS

| | | | | |
|---|---|---|---|---|
| D363,603 | S | 10/1995 | Leveen | |
| 5,605,235 | A | 2/1997 | Johnson | |
| 5,896,602 | A * | 4/1999 | Marblestone | A61G 7/1019 5/81.1 HS |
| 6,149,229 | A * | 11/2000 | Dillon, Jr. | B60R 7/043 297/188.2 |
| D482,195 | S | 11/2003 | Hansen | |
| D483,213 | S | 12/2003 | Hassett | |
| D484,689 | S | 1/2004 | Hansen | |
| D522,750 | S | 6/2006 | Girod | |
| D543,032 | S | 5/2007 | Owenby | |
| D546,705 | S | 7/2007 | Suzuki | |
| D601,799 | S | 10/2009 | Andre | |
| D636,997 | S | 5/2011 | DeVoe | |
| 8,465,090 | B1 * | 6/2013 | O'Connor | A47C 7/62 297/184.16 |
| D694,009 | S | 11/2013 | D'Amore | |
| D709,700 | S | 7/2014 | Nunez | |
| D717,545 | S | 11/2014 | Chuang | |

(Continued)

OTHER PUBLICATIONS

Rio SC642C HiBoy Beach Chair Free Shipping, Island Beach Gear, islandbeachgear.com, Code: S2236, MFG Code: SC6421610, Mar. 1, 2016, https://www.islandbeachgear.com.

*Primary Examiner* — Chi Q Nguyen
(74) *Attorney, Agent, or Firm* — Robert C. Kain, Jr.

(57) ABSTRACT

A cell phone and accessories pouch is attached or attachable an armrest of a chair. An closeable inboard pouch pocket has a transparent view panel for inboard-only visual access to pocket content due to an opaque outboard surface or outboard pocket. Items fall to the bottom of the inboard pocket in a first instance beneath the armrest due to a depending flap near the armrest. In another instance, depending flap wraps around the armrest, placing the stored cellphone atop the armrest and permitting both visual and through-panel tactile access to the cellphone. The size of the pouch is less than the size of the armrest. Pocket closures include zippers, buttons, snaps, hook and loop cloth or ziploc closures. Pouch mounts for removable attachment include snaps, buttons, toggle bars, screws, nuts and tongue-n-groove. The pouch may be permanently affixed to the chair.

20 Claims, 11 Drawing Sheets

(56) References Cited

U.S. PATENT DOCUMENTS

| | | | | |
|---|---|---|---|---|
| D718,935 | S | 12/2014 | Hyzdu | |
| D728,937 | S | 5/2015 | Fridley | |
| 9,039,077 | B1 * | 5/2015 | Santamaria | A47C 7/72 297/31 |
| D741,598 | S | 10/2015 | Calero | |
| D744,236 | S | 12/2015 | Turksu | |
| 9,247,818 | B2 * | 2/2016 | Shively | A47C 4/28 |
| D753,398 | S | 4/2016 | Arami | |
| D764,800 | S | 8/2016 | Juniper | |
| D771,943 | S | 11/2016 | Milstead | |
| 9,642,466 | B2 * | 5/2017 | Milstead | A47C 7/62 |
| 2013/0328362 | A1 | 12/2013 | Miller | |
| 2014/0312659 | A1 * | 10/2014 | Moon | A47C 7/54 297/16.2 |
| 2014/0319883 | A1 * | 10/2014 | Shively | A47C 4/28 297/35 |

* cited by examiner

CHAIR WITH CELL PHONE AND ACCESSORY POUCH

The present invention relates to a chair and a cell phone and accessories pouch which pouch is either attached to the chair or is attachable to one of the arm rests of the chair.

BACKGROUND OF THE INVENTION

Oftentimes consumers carry foldable or collapsible chairs to the beach, concert or to provide seating for lawn related activities. In particular regarding collapsible chairs used on a beach, the user typically enjoys the water and his or her bathing suit is oftentimes wet when he or she sits in the collapsible chair.

With the widespread use of cellular telephones, and the personal desire to be near your cell phone, it is difficult for beachgoers and concertgoers to have reasonable access to their cell phones and yet protect the cell phones from sand, water, salt and sweat.

The present invention seeks to provide a system to simultaneously protect cell phones from such adverse conditions and yet permit the cell phone user to have visual access to the cell phone and tactile through-panel access to the dialing surface of the cell phone.

OBJECTS OF THE PRESENT INVENTION

It is an object of the present invention to provide a chair with and attached cell phone and accessories pouch.

It is another object of the present invention to provide a cell phone and accessories pouch which is either attached or is attachable to an armrest of the chair.

It is a further object of the present invention to provide a pouch having an inboard pocket with a transparent view panel permitting the user to have visual access to the cell phone and a pouch with a depending flap whereby the user can flip over the pouch (customarily attached beneath the armrest) such that the inboard pocket sets atop the armrest and provides tactile through-panel access to the cell phone in the inboard pocket.

It is another object of the present invention to provide various closure systems for the inboard pocket as well as an outboard pocket on the pouch.

It is an additional object of the present invention to provide a privacy panel which is opaque and which covers the transparent view panel on the inboard pocket.

It is another object of the present invention to provide a cell phone and accessories pouch which has an outboard pocket.

It is an additional object of the present invention to provide various mounting systems to mount, on the underside of the armrest, the pouch in a removable manner.

SUMMARY OF THE INVENTION

The cell phone and accessories pouch is attached or is attachable to at least one armrest of a collapsible chair. Various mounting systems for attaching the pouch to the underside of the armrest are provided. The pouch has a closeable inboard pocket hanging below the armrest such that access to the inboard pocket is permitted only from an inboard position defined by the opposing armrests and the chair seat panel. The inboard pocket has a transparent view panel permitting visual access to the cell phone or accessories in the inboard pocket. The inboard pocket has a closed bottom and, when the cell phone or accessories are stored therein, those items fall or migrate to the closed pocket bottom region. The inboard pocket also defined a depending flap which is below and adjacent to the lower armrest of the surface. The depending flap spatially separates the closed bottom from the lower armrest surface and therefore spaces apart the cell phones and accessories stored in the inboard pocket.

In a first operational mode, the closed bottom adjacently storing cell phone or accessories are spaced beneath and away from the lower armrest surface. In a second operational mode, the depending flap is wrapped around a portion of the armrest such that the stored cell phone or accessories rest on top the upper armrest surface. In this manner, in the second operational mode, the user is permitted both visual access to the cell phone or accessories stored in the inboard pocket and is permitted through-panel tactile access to the cell phone or accessories which are stored in the inboard pocket. The width, length, depth and height of the pouch is configured to effectively hide the pouch beneath the armrest. Closure elements are provided for all the pouch pockets which may be zipper, button, snap, hook and loop cloth or ziploc closures. In one embodiment, the pouch has an outboard pocket which has an opaque surface. The outboard surface of the pouch is opaque which blocks any view of the items stored in the inboard pocket. In a further embodiment, the opaque outboard pocket as a closure element thereby permitting access to the inboard pocket from the outboard closure element and access to the inboard pocket through the inboard closure element. A further alteration includes a through passage for an earphone wire on the opaque outboard pocket. Various mounting mechanism are utilized to removably attach the pouch to the armrest. These include snaps, buttons, toggle bars operable through a hole or slot, a screw and nut system, and a tongue and groove system.

In some situations, the pouch is permanently affixed to the collapsible chair. Therefore the invention covers a collapsible chair with an attached cell phone and accessories pouch.

BRIEF DESCRIPTION OF THE DRAWINGS

Further objects and advantages of the present invention can be found in the detailed description of the preferred embodiments when taken in conjunction with the accompanying drawings in which:

FIG. 3 shows a hook and loop cloth closure element. FIG. 1 show a pouch mounted onto the lower surface of the armrest by a rivet, screw, nails or bolt threaded into a chambered thread.

DETAILED DESCRIPTION OF THE PREFERRED EMBODIMENTS

The present invention relates to a chair with a cell phone and accessories pouch and also relates to a cell phone and accessories pouch attached or attachable to the underside of an armrest for a collapsible or foldable chair. Similar numerals designate similar items throughout the drawings. Although the drawings show a single pouch mounted beneath one armrest, the chair may include two pouches, each pouch mounted beneath a respective armrest. Also as described herein, the pouch can be sold separately of the chair and can be mounted beneath the armrest with a complementary underside mounting system. Further the underside mounting system may be sold with the to be mounted pouch.

Figure 1:
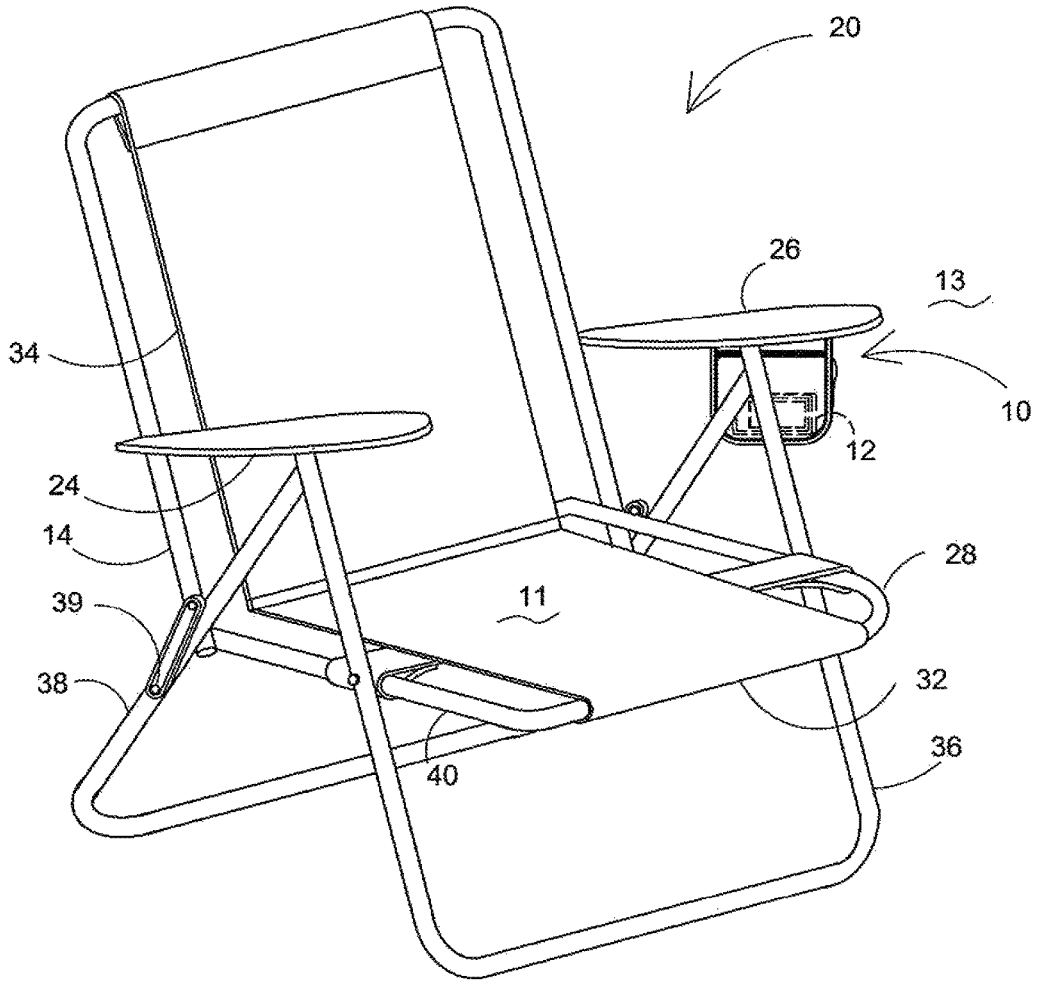
FIG. 1 diagrammatically illustrates a foldable chair with the cell phone and accessories pouch mounted beneath one of the armrests of the chair.

FIG. 1 shows collapsible chair 20 with an attached cell phone and accessories pouch 10. Chair 20 includes a forward leg system 36 pivotally attached at pivot point 37 to a rearward leg system 38. A seat frame 28 holds a seat panel 32. The seat panel spans an inboard chair region 11. The inboard chair region is defined by opposing armrest 24, 26 and seat panel 32. Seat frame 28 is movably attached to the forward frame section 36. Supporting cross member 40 maintains the stability of the chair. A back support frame 14 has a back support element 34 also spanning the inboard chair region 11. Back support frame 14 is pivotally attached to the rearward leg system 38 at pivot point 39. Armrests 24, 26 are pivotally attached to the back frame support at pivot point 41 and attached to either or to both of the forward leg system 36 and the rearward leg system 38.

Pouch 10 is mounted beneath at least one armrest 26. A cell phone 12 is visible through the view panel of the inboard pocket of pouch 10. In this manner, the user, seated on seat panel 32 can see activity on the cell phone display panel or surface.

Figure 2:
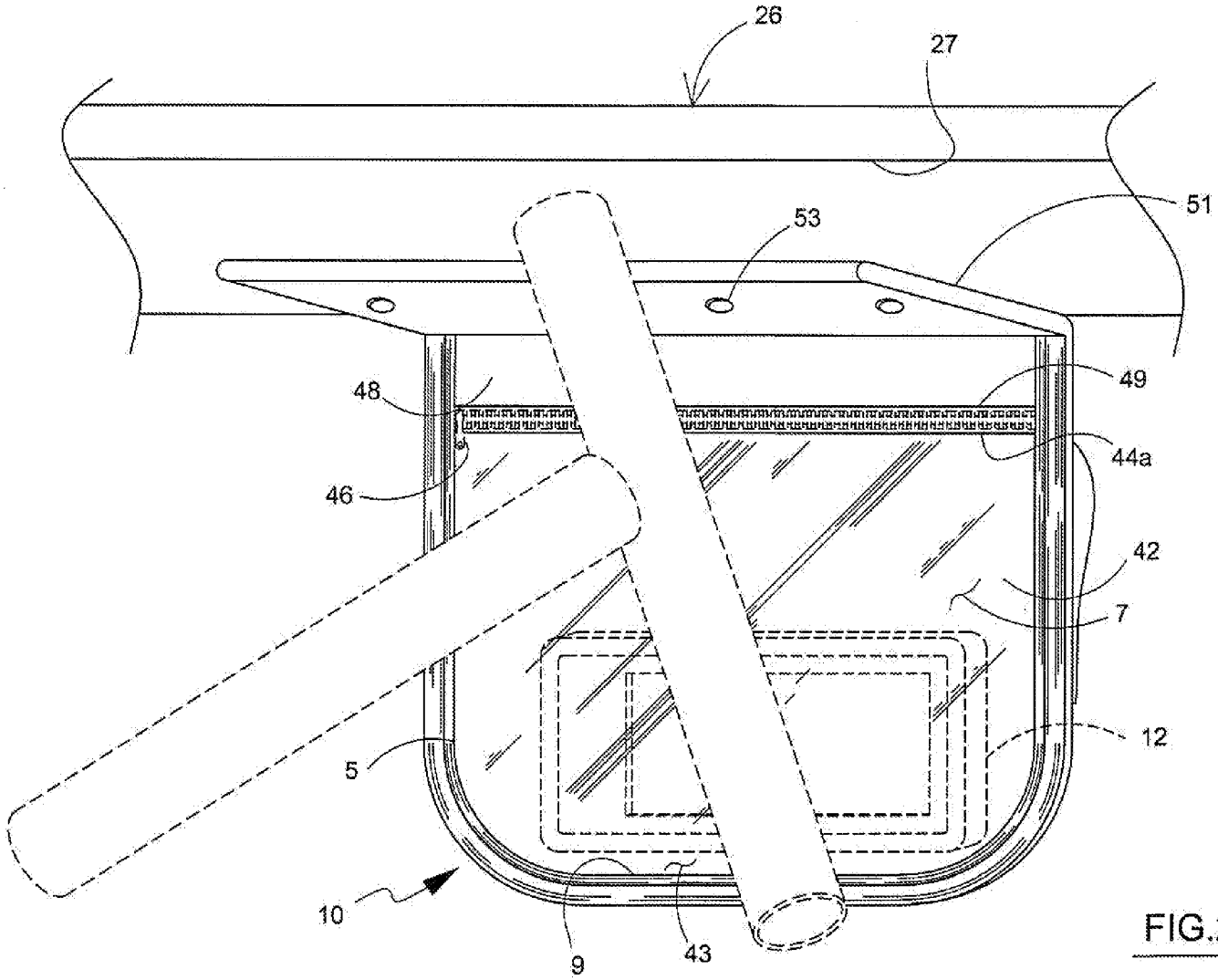
FIG. 2 diagrammatically illustrates the pouch and, more particularly, the transparent view panel in the inboard pouch pocket.

FIG. 2 diagrammatically illustrates that cell phone 12 is adjacent the lower region 43 near the bottom edge 9 of the interior space 7 of inboard pocket 5. A transparent view panel 42 permits the user to see the contents inside the inboard pouch 10. In the preferred embodiment, transparent view panel 42 substantially covers almost all of the inboard surface of pouch 10.

As used herein, the term "inboard" refers to items closer to inboard chair space 11 (FIG. 1) which is defined by armrests 24, 26 and seat panel 32 and, to some extent, back support panel 34. Items which are outside the space, that is in outboard region 13 (FIG. 1) are beyond the boundaries of inboard space 11. Therefore, in FIG. 2, the inboard surface of pouch 10 is shown as having an inboard pocket 5 which defines a viewable space interior space 7 in the pocket 5.

The user can access inboard pocket 5 by opening and closing a closure element. In the preferred embodiment, the closure element is spaced apart from the underside 27 of armrest 26 by a depending flap 48 defined by pouch 10. Various closure elements may be utilized between depending flap 48 and inboard pocket 5. For example, FIG. 2 shows a zipper closure 44 a which is opened and closed by the pull tab 46. However the closure element for the inboard pocket 5 may be a button system, a snap system, a hook and loop cloth closure system, or a ziplock (bead in channel) closure. Buttons, snaps, hook-loops and other closure systems are discussed in connection with other features of pouch 10.

Pouch 10 also has a surface or segment 51 which is mounted to lower surface 27 of armrest 26 by a mounting system diagrammatically shown as mount 53 in FIG. 2. Mount 53 could be rivets, screws, bolts operating on threaded nuts buried in the interior of armrest 26 or may be nails. The purpose of depending flap 48 is discussed later.

Access to the inboard pocket 5 is permitted only from inboard position 11 of chair 20. As described later in connection with one embodiment, the opaque outboard pocket as a closure element thereby permitting access to the inboard pocket from the outboard closure element and access to the inboard pocket through the inboard closure element. A further alteration includes a through passage for an earphone wire on the opaque outboard pocket.

As stated earlier, inboard pocket 5 has a closed bottom 9 defining a lower pocket space 43. The cell phone or accessories in pocket space 7 migrate to the closed bottom region 9. In this manner, the cell phone and accessories are away from armrest 26 and are viewable through view panel 42.

Figure 3:
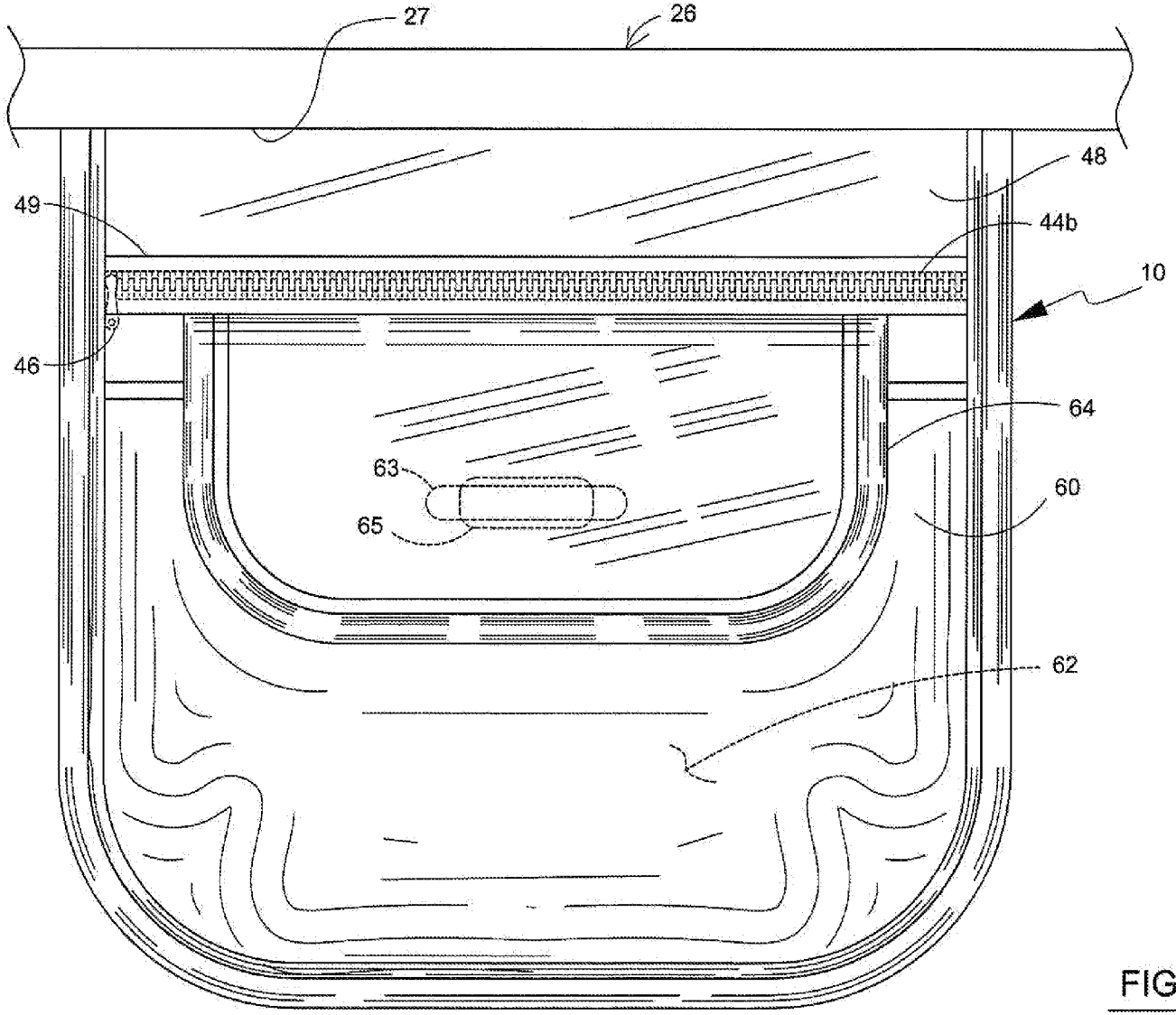
FIG. 3 diagrammatically illustrates the pouch with an outboard pocket.

In FIG. 3, the outboard surface of pouch 10 is illustrated. In this embodiment, pouch 10 has an outboard pocket 60 which has an opaque or nontransparent cover. Further, depending flap 48 is also opaque. Sewn lines 4 are shown as long dash dot dash lines the Figures. However, other types of structural attachment mechanisms may be utilized. In FIG. 3, outboard zipper 44*b* can be opened and closed to permit access to inboard pocket 5 by opening and closing the pull tab 46 of zipper 44*b*. In this manner, the user can access phone 12 or other accessories either by inboard zipper 44*a* or by outboard zipper 44*b*. Importantly, the outboard surface of the pouch is not transparent therefore casual observers cannot see the contents of inboard pouch 5. The pouch has an outboard pocket which has an opaque surface. The outboard surface of the pouch is opaque which blocks any view of the items stored in the inboard pocket. The opaque outboard pocket as a closure element thereby permitting access to the inboard pocket from the outboard closure element and access to the inboard pocket through the inboard closure element. A further alteration includes a through passage for an earphone wire on the opaque outboard pocket. The earphone wire passage enables the use to listen to music or engage in conversation when the wire connects to the cell phone stored in the inboard pocket since the wire runs from the phone in the inboard pocket, through the earphone wire passage to the user.

The outboard pouch 60 has a flap closure 64. Flap closure 64 is removably attachable to the outer surface of outboard pocket 60 via a hook and loop closure system diagrammatically illustrated by panels 63, 65. The user is permitted access to interior space 62 of outboard pocket 60 by opening and closing the outboard flap 64.

Figure 4:
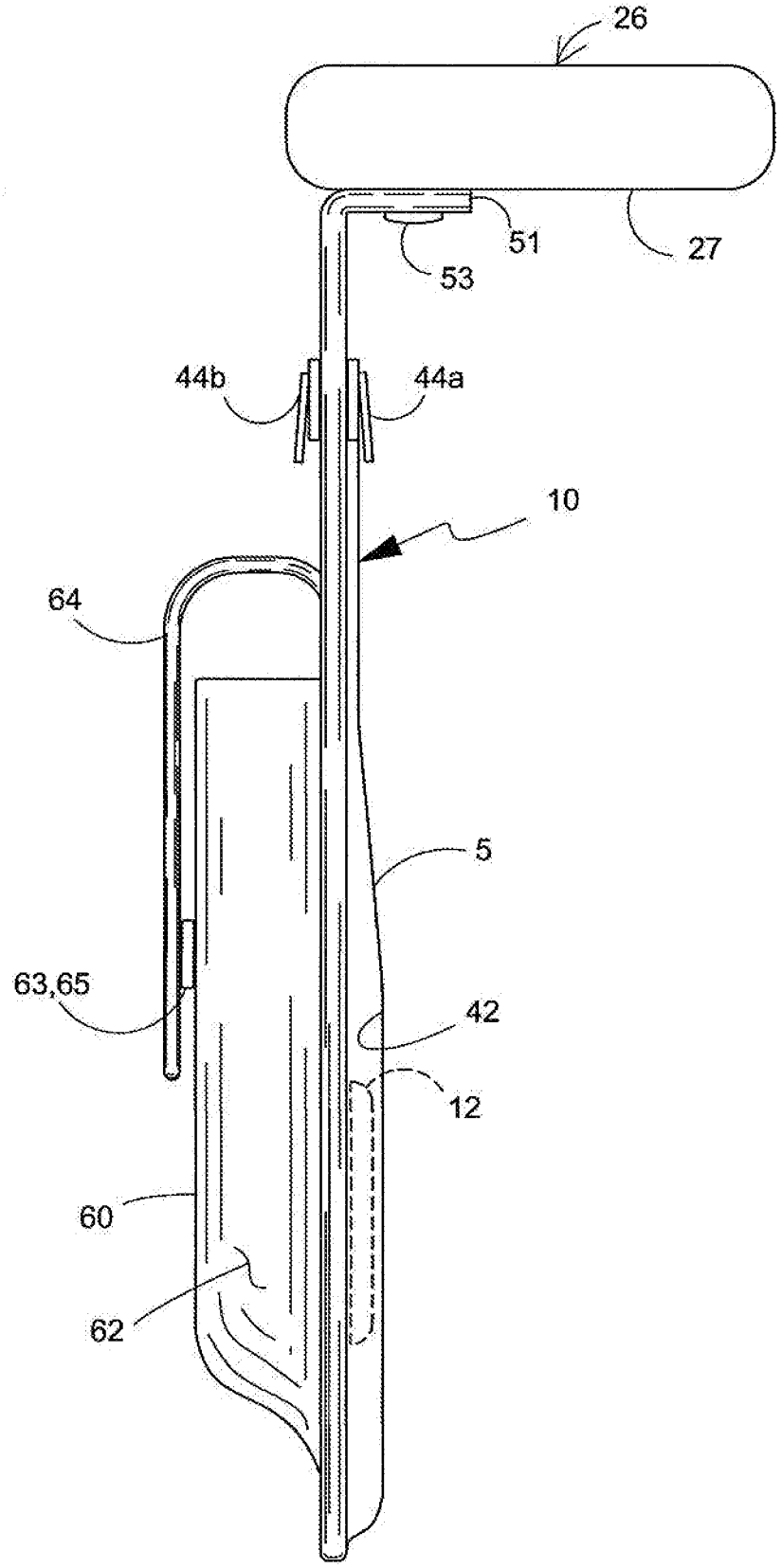
FIG. 4 diagrammatically illustrates a rear elevational view of the pouch.

FIG. 4 diagrammatically shows a rear elevational view of pouch 10. Cell phone 12 is disposed in inboard pocket 5 and is viewable through transparent panel 42. Outboard pocket 60 has a pocket space 62. Hook and loop closure system 63, 65 are diagrammatically illustrated. Closure flap 64 closes the open top of outboard pocket 60. Depending flap 48 spaces both the access passages to the inboard pocket 5 which access passages are defined by zipper pulls 44*a*, 44*b* as well as spaces the inboard pocket 5 downward and away from lower surface 27 of armrest 26.

Figure 5:
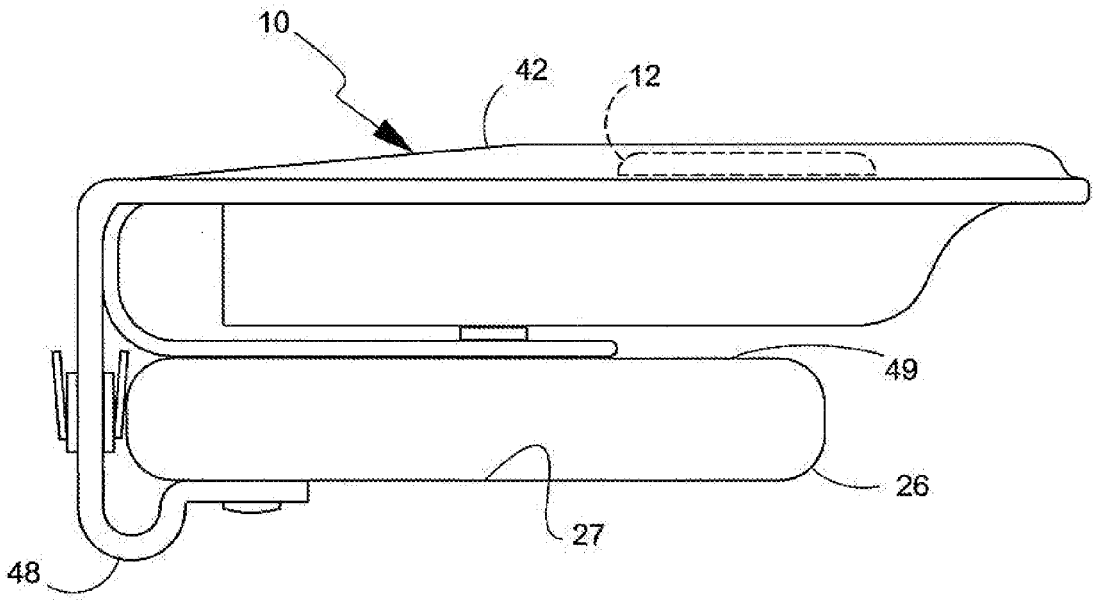
FIG. 5 diagrammatically illustrates the pouch flipped over and wrapping around the armrest and sitting atop the top surface of the armrest.

FIG. 5 diagrammatically illustrates that pouch 10 can be flipped around such that depending flap 48 wraps around the armrest 26. In this second mode of operation, cell phone 12 is visible through transparent panel 42 further. Further pouch 10 sets atop the top surface 49 of armrest 26.

Therefore the present invention has two operational modes. In the first operational mode, the cell phone or accessories are near or adjacent the closed bottom 9 of inboard pocket 5. The cell phone or accessories are stored in a spaced apart manner beneath lower surface 27 of the armrest 26 by depending flap 48. This is show in FIG. 2. The user can place objects into the inboard pocket via either the inboard closure element or the outboard closure element.

In a second operational mode, the depending flap 4 wraps around a portion of the armrest such that the stored cell phone and accessories rest atop the upper armrest surface 49. See FIG. 5. In this second mode of operation, the user has both visual access to the cell phone or accessories (stored in the inboard pocket 5) and has tactile through-panel access to the cell phone or accessories which are also stored in the inboard pocket.

This feature of flipping the pouch over and placing the pouch atop the armrest and permitting operation of the cell phone through the transparent view panel enables the user to limit sand, dust, sweat, water, salt and other undesirable elements to come into contact with the cell phone or the accessories. Further the cell phone and the accessories, being captured in the inboard pocket 5 on one side viewable by transparent panel but being hidden on the other side by an opaque panel (the opaque side 60 of pouch 10 shown in FIG. 3), enables some degree of security with respect to the cell phone and accessories. Simultaneously, the user can see the cell phone display surface through the transparent cover in both the first and the second mode of operation. When the cell phone rings or otherwise displays a visual alert, the user can simply flip over the pouch, place it atop the armrest 26 and activate the display buttons on the cell phone through the view panel. All the while, sweat, sand, salt and water do not adversely affect the cell phone or the accessories stored in the inboard pocket 5.

As shown in the various figures, the pouch has dimensional width, length, depth and height such that the width and the length of the pouch is smaller than the dimensional armrest width and dimensional armrest length. The dimensional pouch height is less than the dimensional height between the lower armrest surface and seat panel 32. Further, the dimensional height of the depending flap is more than twice the dimensional height or thickness of armrest 26. This enables the flap 48 to flip over the edge of the armrest 26. Sometimes, the distance of the dimensional height of the flap 48 is called flap-to-lower surface spacing.

Figure 6:
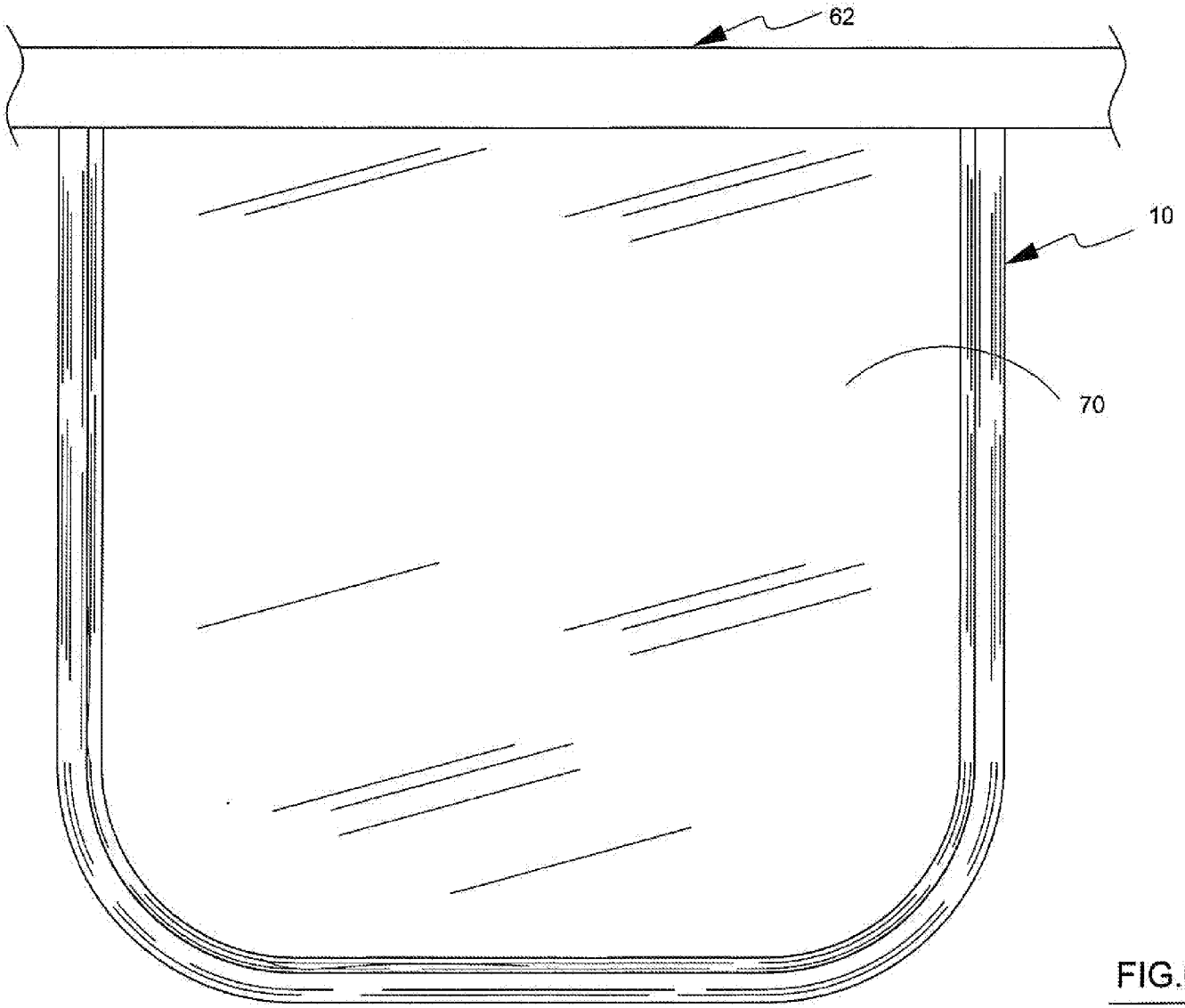
FIG. 6 diagrammatically illustrates an opaque outboard side of the pouch.

FIG. 6 shows that the outer surface of pouch 10 can be a simple opaque surface. FIG. 6 does not show an outboard pocket. A modification of the simple unitary opaque surface is the addition of an outboard closure element (permitting outboard access to the inboard pocket) as shown and described earlier, and the addition of an earphone wire passage into the inboard pocket.

Figure 7:
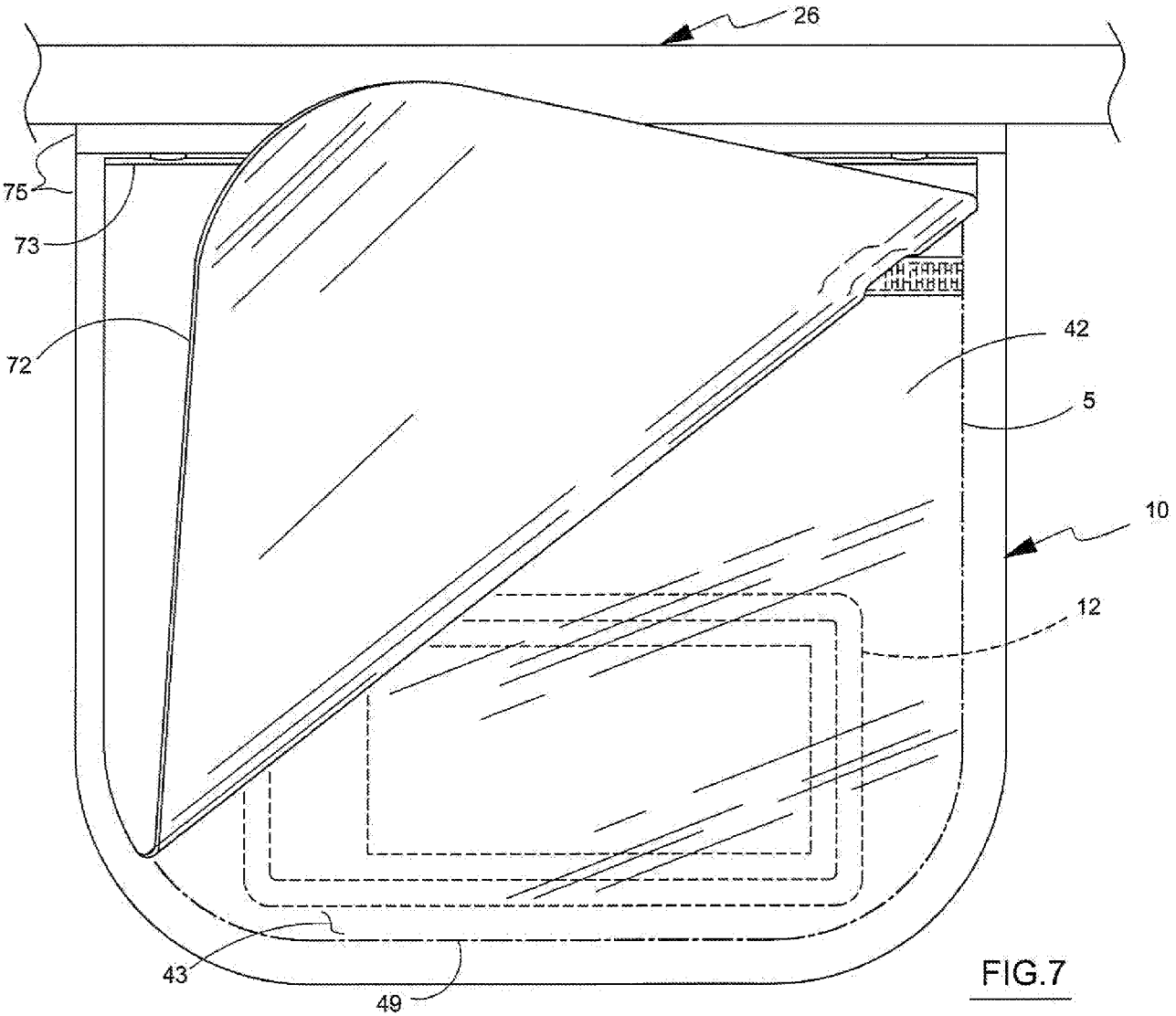
FIG. 7 diagrammatically illustrates the privacy panel substantially covering the transparent view panel for the inboard pocket of the pouch.

FIG. 7 shows a privacy panel 72 attached at an upper edge 73 to an upper region 75 of pouch 10. In a preferred embodiment, privacy panel 72 covers the entire view area of transparent viewable panel 42. In this manner, any cell phone or accessory stored inside the inboard pouch 5 is not viewable from an inboard viewpoint as well as an outboard viewpoint. As stated earlier, the outboard side of pouch 10 has an opaque surface.

FIGS. 8, 9, 10, 11A and 11B show various mounting systems for mounting the pouch onto the lower surface 27 of armrest 26. Some mounting systems can be re-configured and used as closure systems for the pockets. Some of the closure elements discussed above can be used as mounting systems. For example, the zipper closure can be used as a mounting system then an additional flap is attached to the underside of the arm rest and carries one zipper component and the depending flap of the pouch carries the complimentary zipper component, thereby permitting the pouch to be zipped onto the arm rest. Also, the mounting system may use a hook and loop cloth mount as shown in connection with the outboard pocket.

Figure 8:
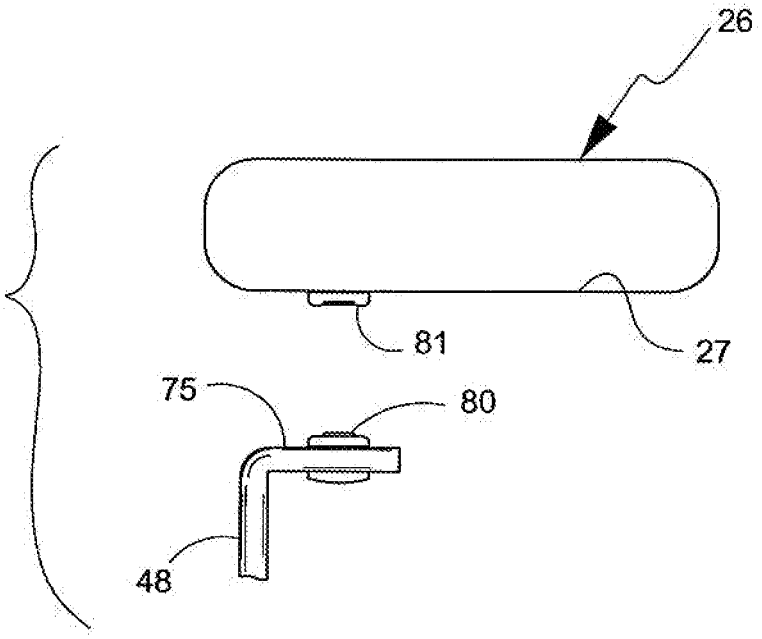
FIGS. 8, 9, 10, 11A and 11B diagrammatically illustrate mounting systems for mounting the pouch on the armrest. It should be note that several of these mounting systems also operate as closure systems for the inboard pocket in the outboard pocket.

FIG. 8 shows a snap system with complementary snap elements 80, 81. If the pouch 10 is removable from armrest 26, depending flap 48 may have a stiff panel segment or band 75 to enable the user to easily mount and thereafter remove the pouch from the armrest.

Figure 9:
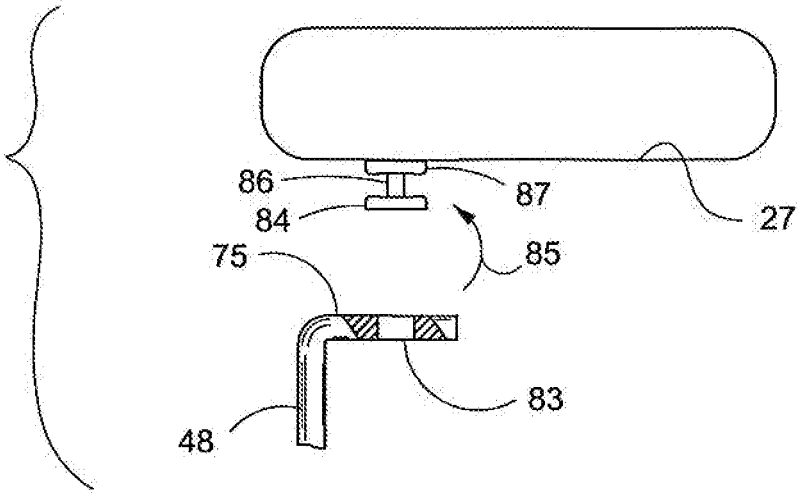

FIG. 9 diagrammatically illustrates a toggle bar 84 which can be moved in the direction shown by arrow 85 and inserted into toggle hole or slot 83 in band element 75 of the pouch system. Toggle bar 8 is attached via flexible stem 86 to base 87. Of course, a button and buttonhole system is effectively the same as the toggle system described herein. In a button system, the length of flexible stem 86 is foreshortened, the button is round rather than a bar and the button head 84 is inserted into a buttonhole 83 of band 75.

Figure 10:
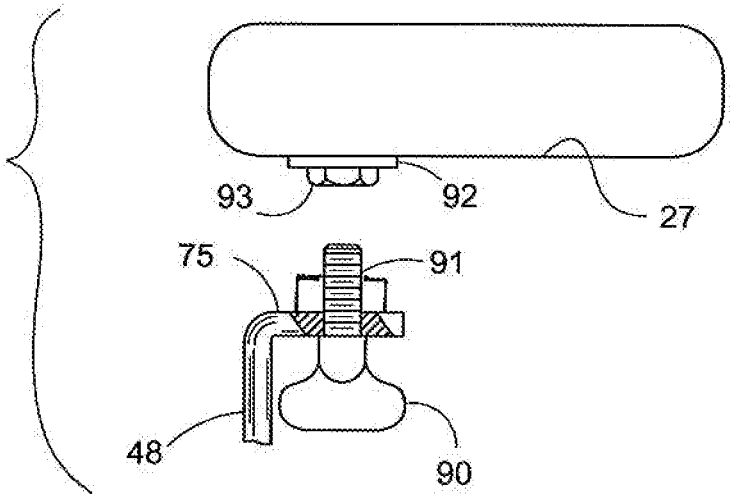

FIG. 10 diagrammatically illustrates that a threaded bolt and nut-screw system with a user actuation knob 90 operating a threaded bolt into threaded nut 93. Threaded bolt 91 interacts with nut threads 93 to attach band 75 to base 92 and lower surface 27 of the armrest.

Figure 11A:
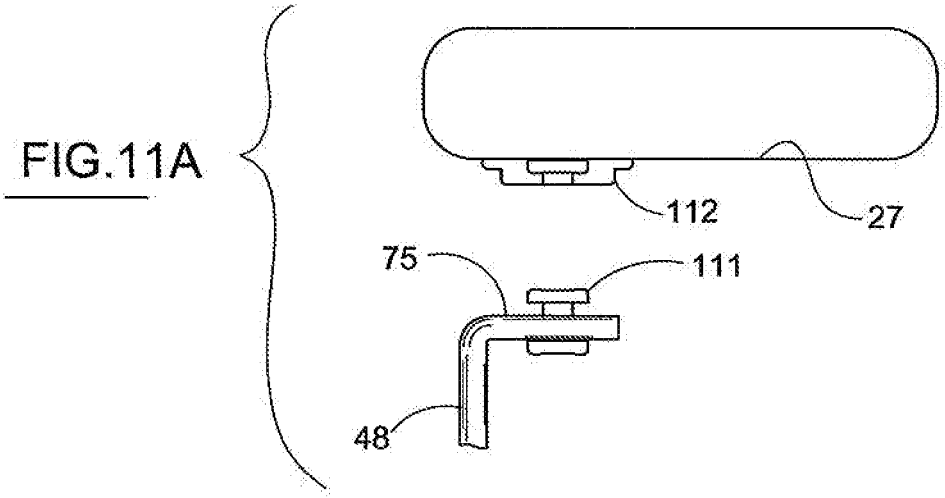
Figure 11B:
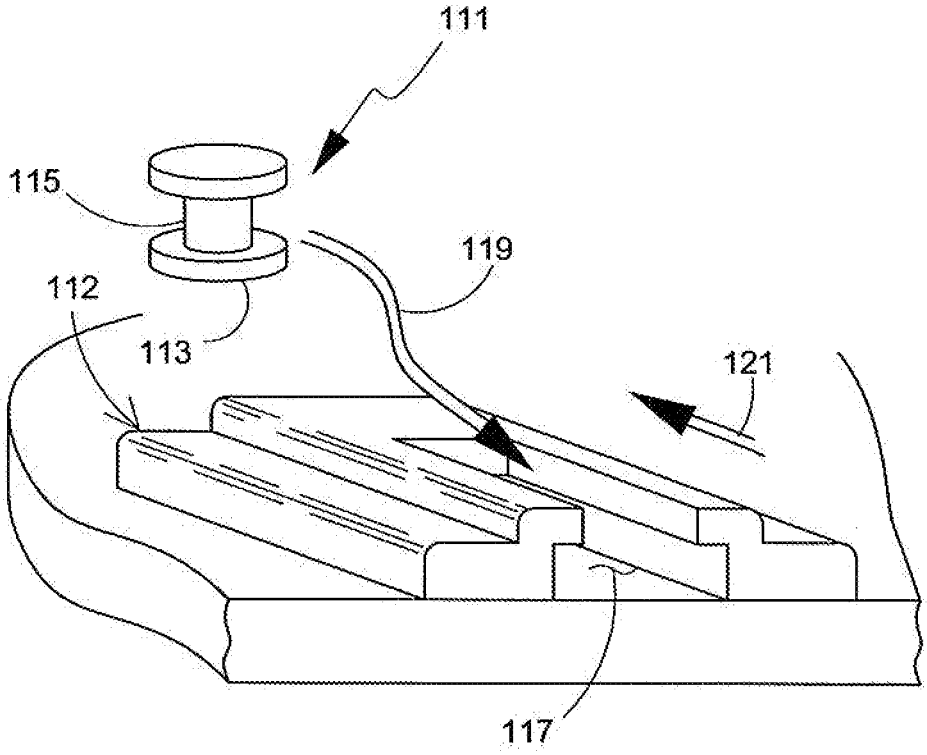

FIGS. 11A and 11B diagrammatically illustrate a tongue and groove system. The tongue is shown in FIG. 11A as T-shaped tongue 111. Tongue 111 slides into channel groove base 112 thereby attaching band 75 and depending flap 48 to the lower surface 27 of the armrest. FIG. 11B is a perspective underside view of the system wherein base 112 defines a groove 117 with a partly closed mouth. Tongue 111 has a wider head 113 and a narrow stem 115. The head 113 is inserted as shown by arrow 119 into the opening of the slot channel 117. Then the system is then moved in the slot as shown by direction arrow 121. This movement captures head 113 beneath the opposing inboard edges of slot 117 thereby locking the tongue unit 111 into the groove unit 122.

The claims appended hereto are cut meant to cover modifications and changes within the scope of the present invention.

What is claimed is:

1. A cell phone and accessories pouch attached to at least one of a pair of opposing chair arm rests on a collapsible chair wherein the chair includes a seat panel and a back support panel, comprising:

a pouch mounted beneath said one arm rest;

said pouch having an closeable inboard pouch pocket hanging below said one arm rest such that access to said inboard pocket is permitted only from an inboard position defined by said opposing arm rests and the chair seat panel;

said inboard pocket having an inboard transparent view panel permitting visual access to said cell phone or accessories stored in said inboard pocket;

said inboard pocket having a closed bottom wherein said cell phone or accessories stored therein migrate to said closed bottom while stored in said inboard pocket;

said inboard pocket defining a depending flap below and adjacent to a lower arm rest surface which said depending flap spatially separates said closed bottom from said lower arm rest surface;

in a first operational mode, said closed bottom and the adjacently stored cell phone or accessories being spaced beneath and away from the lower arm rest surface; and in a second operational mode, said depending flap being wrapped around a portion of said arm rest such that said stored cell phone or accessories rest atop an upper arm rest surface, thereby permitting both visual access to said cell phone or accessories stored in said inboard pocket and through-panel tactile access to said cell phone or accessories stored in said inboard pocket.

2. A cell phone and accessories pouch as claimed in claim 1 wherein said pouch has a dimensional width, length, depth and height and the dimensional width and length is smaller than a dimensional chair arm rest width and length and the dimensional pouch height is less than the dimensional height between the lower arm rest surface and said seat panel; and said transparent view panel spans substantially all of an inboard surface of said inboard pocket; and the pouch having a closure element for said inboard pocket which closure element is beneath said depending flap, said closure element being one of a zipper, button-up, snap, hook-and-loop cloth or ziplock closure.

3. A cell phone and accessories pouch as claimed in claim 2 wherein a dimensional height of said depending flap is more than twice a dimensional height of the arm rest and said depending flap spaces said closure element apart from the lower arm rest surface in said first operational mode and the flap-to-lower surface spacing enables the warp around of the pouch in the second operational mode thereby permitting top surface access to said closure element in said second operational mode.

4. A cell phone and accessories pouch as claimed in claim 1 including a closeable outboard pocket with an opaque surface.

5. A cell phone and accessories pouch as claimed in claim 1 wherein the pouch has an opaque outboard surface covering the substantially all of said inboard pocket.

6. A cell phone and accessories pouch as claimed in claim 5 including a closeable outboard pocket on said opaque outboard surface of said pouch, said outboard pocket having an outboard closure element being one of a zipper, button-up, snap, hook-and-loop cloth or ziplock closure.

7. A cell phone and accessories pouch as claimed in claim 1 including an opaque privacy flap covering substantially all of said transparent view panel, said privacy flap disposed inboard of said transparent view panel and only attached to said pouch along an upper edge of said privacy panel such that upon a lifting up of said privacy flap, visual access is permitted to said cell phone or accessories stored in said inboard pocket.

8. A cell phone and accessories pouch as claimed in claim 7 wherein said pouch has a dimensional width, length, depth and height and the dimensional width and length is smaller than a dimensional chair arm rest width and length and the dimensional pouch height is less than the dimensional height between the lower arm rest surface and said seat panel; and said transparent view panel spans substantially all of an inboard surface of said inboard pocket; and the pouch having a closure element for said inboard pocket which closure element is beneath said depending flap, said closure element being one of a zipper, button-up, snap, hook-and-loop cloth or ziplock closure.

9. A cell phone and accessories pouch as claimed in claim 8 wherein a dimensional height of said depending flap is more than twice a dimensional height of the arm rest and said depending flap spaces said closure element apart from the lower arm rest surface in said first operational mode and the flap-to-lower surface spacing enables the pouch to be wrapped around the arm rest in the second operational mode thereby permitting top surface access to said closure element in said second operational mode.

10. A cell phone and accessories pouch as claimed in claim 9 including a closeable outboard pocket with an opaque surface.

11. A cell phone and accessories pouch as claimed in claim 10 wherein the pouch has an opaque outboard surface covering the substantially all of said inboard pocket, said outboard pocket mounted on said opaque pouch surface.

12. A cell phone and accessories pouch as claimed in claim 11, said outboard pocket having an outboard closure element being one of a zipper, button-up, snap, hook-and-loop cloth or ziplock closure.

13. A cell phone and accessories pouch as claimed in claim 12 wherein said pouch is removably mounted to the lower arm rest surface via said depending flap.

14. A cell phone and accessories pouch as claimed in claim 13 wherein said pouch is removably mounted to the lower arm rest surface via an attachment element between said depending flap and said lower arm rest surface, said attachment element being one of a snap, a button operable with a button hole on said pouch, a toggle bar operable with a hole or slot on said pouch, a screw and nut system, and a tongue and groove system.

15. A cell phone and accessories pouch as claimed in claim 1 wherein said pouch is removably mounted to the lower arm rest surface via said depending flap.

16. A cell phone and accessories pouch as claimed in claim 15 wherein said pouch is removably mounted to the lower arm rest surface via an attachment element between said depending flap and said lower arm rest surface, said attachment element being one of a snap, a button operable with a button hole on said pouch, a toggle bar operable with a hole or slot on said pouch, a screw and nut system, and a tongue and groove system.

17. A collapsible chair with an attached cell phone and accessories pouch comprising:

a forward leg system pivotally attached to a rearward leg system;

a seat frame with a seat panel spanning an inboard chair region and movable attached with respect to said forward leg system;

a back support frame with a back support element spanning the inboard chair region and pivotally attached to said rearward leg system;

a pair of opposed chair arm rests pivotally attached to said back support frame and pivotally attached to (i) said forward leg system, (ii) said rearward leg system, or (iii) both said forward leg system and said rearward leg system;

a pouch mounted beneath at least one arm rest;

said pouch having an closeable inboard pouch pocket hanging below said one arm rest such that access to said inboard pocket is permitted only from an inboard position defined by said opposing arm rests and the chair seat panel;

said inboard pocket having an inboard transparent view panel permitting visual access to said cell phone or accessories stored in said inboard pocket;

said inboard pocket having a closed bottom wherein said cell phone or accessories stored therein migrate to said closed bottom while stored in said inboard pocket;

said inboard pocket defining a depending flap below and adjacent to a lower arm rest surface which depending flap spatially separates said closed bottom from said lower arm rest surface;

in a first operational mode, said closed bottom and the adjacently stored cell phone or accessories being spaced beneath and away from the lower arm rest surface; and in a second operational mode, said depending flap being wrapped around a portion of said arm rest such that said stored cell phone or accessories rest atop an upper arm rest surface, thereby permitting both visual access to said cell phone or accessories stored in said inboard pocket and through-panel tactile access to said cell phone or accessories stored in said inboard pocket.

18. A chair with a cell phone and accessories pouch as claimed in claim 17 including an opaque privacy flap covering substantially all of said transparent view panel, said privacy flap disposed inboard of said transparent view panel and only attached to said pouch along an upper edge of said privacy panel such that upon a lifting up of said privacy flap, visual access is permitted to said cell phone or accessories stored in said inboard pocket.

19. A chair with a cell phone and accessories pouch as claimed in claim 18 wherein said pouch has a dimensional width, length, depth and height and the dimensional width and length is smaller than a dimensional chair arm rest width and length and the dimensional pouch height is less than the dimensional height between the lower arm rest surface and said seat panel; and said transparent view panel spans substantially all of an inboard surface of said inboard pocket;

the pouch having a closure element for said inboard pocket which closure element is beneath said depending flap, said closure element being one of a zipper, button-up, snap, hook-and-loop cloth or ziplock closure;

wherein a dimensional height of said depending flap is more than twice a dimensional height of the arm rest and said depending flap spaces said closure element apart from the lower arm rest surface in said first operational mode and the flap-to-lower surface spacing enables the pouch to be wrapped around the arm rest in the second operational mode thereby permitting top surface access to said closure element in said second operational mode; and said pouch has an opaque outboard surface covering the substantially all of said inboard pocket, said outboard pocket mounted on said opaque pouch surface.

20. A chair with a cell phone and accessories pouch as claimed in claim 19 wherein said pouch is removably mounted to the lower arm rest surface via an attachment element between said depending flap and said lower arm rest surface, said attachment element being one of a snap, a button operable with a button hole on said pouch, a toggle bar operable with a hole or slot on said pouch, a screw and nut system, and a tongue and groove system.

* * * * *